US008291825B2

(12) United States Patent
Aliaghai et al.

(10) Patent No.: US 8,291,825 B2
(45) Date of Patent: Oct. 23, 2012

(54) METHODS AND APPARATUSES FOR ELECTRO-MECHANICAL SAFETY AND ARMING OF A PROJECTILE

(75) Inventors: Hossein Aliaghai, Plymouth, MN (US); Kristen L. Gerzina, Maple Grove, MN (US); Dennis Lagerquist, Roseville, MN (US)

(73) Assignee: Alliant Techsystems Inc., Arlington, VA (US)

( * ) Notice: Subject to any disclaimer, the term of this patent is extended or adjusted under 35 U.S.C. 154(b) by 415 days.

(21) Appl. No.: 12/557,028

(22) Filed: Sep. 10, 2009

(65) Prior Publication Data

US 2011/0056401 A1 Mar. 10, 2011

(51) Int. Cl.
*F24C 15/34* (2006.01)

(52) U.S. Cl. ..... 102/254; 102/231

(58) Field of Classification Search ..... 102/221, 102/231, 232, 233, 235, 237, 238, 244, 245, 102/247, 249, 251, 254, 256
See application file for complete search history.

(56) References Cited

U.S. PATENT DOCUMENTS

| | | | | |
|---|---|---|---|---|
| 4,470,351 | A * | 9/1984 | Farace | 102/232 |
| 4,796,532 | A * | 1/1989 | Webb | 102/233 |
| 5,027,708 | A * | 7/1991 | Gonzalez et al. | 102/254 |
| 5,131,328 | A | 7/1992 | Chan | |
| 5,147,975 | A * | 9/1992 | Munach et al. | 102/264 |
| 5,243,912 | A | 9/1993 | Ziemba | |
| 5,271,327 | A | 12/1993 | Filo et al. | |
| 5,693,906 | A | 12/1997 | Van Sloun | |
| 7,004,072 | B1 | 2/2006 | Ceola | |
| 7,258,068 | B2 | 8/2007 | Worthington | |
| 7,320,286 | B2 | 1/2008 | Karmazyn | |
| 7,357,081 | B2 | 4/2008 | Zinell et al. | |
| 7,360,486 | B2 | 4/2008 | Alculumbre et al. | |
| 7,367,268 | B2 | 5/2008 | Westphal et al. | |
| 7,461,596 | B2 | 12/2008 | Zinell et al. | |
| 7,490,551 | B2 | 2/2009 | Golay et al. | |
| 7,798,064 | B1 * | 9/2010 | Taylor | 102/251 |
| 8,037,826 | B2 * | 10/2011 | Taylor | 102/237 |
| 8,061,272 | B2 * | 11/2011 | Taylor | 102/235 |
| 2008/0078299 | A1 | 4/2008 | Kienzler et al. | |
| 2008/0115686 | A1 | 5/2008 | Crist et al. | |
| 2008/0210117 | A1 | 9/2008 | Zinell et al. | |
| 2010/0251918 | A1 * | 10/2010 | Taylor | 102/238 |
| 2011/0036258 | A1 * | 2/2011 | Taylor | 102/235 |
| 2011/0203474 | A1 * | 8/2011 | Westphal et al. | 102/256 |

FOREIGN PATENT DOCUMENTS

FR 2691797 A1 * 12/1993

* cited by examiner

*Primary Examiner* — Benjamin P Lee
(74) *Attorney, Agent, or Firm* — TraskBritt

(57) ABSTRACT

A safety and arming apparatus for use with a projectile includes a rotor pivotable between a safe position and an armed position. A biasing element holds a mass engaged with the rotor to restrain the rotor from rotation and is deformable to allow the mass to displace and disengage from the rotor in response to a setback force on the projectile. A second biasing element includes a displaceable end for engaging with the rotor to restrain the rotor from rotation and is deformable to disengage the displaceable end from the rotor in response to projectile spin. A piston actuator can rotate the rotor to the armed position if the mass is disengaged and the displaceable end is disengaged. A detonator on the rotor can be aligned with a detonation cord when the rotor is in the armed position and unaligned when the rotor is in the safe position.

15 Claims, 8 Drawing Sheets

METHODS AND APPARATUSES FOR ELECTRO-MECHANICAL SAFETY AND ARMING OF A PROJECTILE

TECHNICAL FIELD

Embodiments of the present invention relate generally to safety and arming devices and, more particularly, to an electro-mechanical safety and arming apparatus for use with fuzes in explosive projectiles.

BACKGROUND

Explosive projectiles must be capable of being handled safely under considerable stress and environmental conditions. In addition, explosive projectiles must be capable of detonating at the proper time. Depending on the application, this proper time may be before impact, at a specific point during flight, during impact, or at some time delay after impact. As used herein, the terms "warhead," "explosive device," and "explosive projectile" are generally used to refer to a variety of projectile type explosives, such as, for example, artillery shells, rockets, bombs, and other weapon warheads. To determine the proper detonation time, these explosive projectiles frequently employ fuzes.

A fuze subsystem activates the explosive projectile for detonation in the vicinity of the target. In addition, the fuze maintains the explosive projectile in a safe condition during logistical and operational phases prior to launch and during the first phase of the launch until the explosive projectile has reached a safe distance from the point of launch. In summary, major functions that a fuze performs are; keeping the weapon safe, arming the weapon when it is a safe distance from the point of launch, and initiating detonation of the warhead at some definable point after launch.

The first two functions of keeping the weapon safe and arming the weapon are conventionally referred to as safing and arming. Safety and Arming (S&A) devices isolate a detonator from the warhead booster charge until the explosive projectile has been launched and a safe distance from the launch vehicle is achieved. At that point, the S&A device removes a physical barrier from the explosive train, which effectively arms the detonator so it can initiate detonation at the appropriate time.

For maximum safety and reliability of a fuze, the sensed forces or events must be unique to the explosive projectile when deployed and launched, not present during ground handling or pre-launch operations. Most fuzes must determine two independent physical parameters before determining that a launch has occurred and a safe separation distance has been reached. The first environment utilized in many S&A devices is setback acceleration. Setback acceleration when the projectile is launched is a relatively easy environment to sense. The second environment can be based on a number of different parameters such as elapsed time, barrel escape, and turns counting.

In safety and arming devices using elapsed time and turns counting, the second environment is sensed and determined with electronic elements. However, for simplicity and safety, it may be desirable to have two different physical environments determined with mechanical systems.

Further, prior devices may be difficult to modify for use in projectiles of various sizes, especially smaller projectiles. It may be desirable to design a safety and arming device which is able to be used in several different size rounds. In addition, it may also be desirable to include the reliability and accuracy of electronics for some timing and control functions in addition to the safety afforded by mechanical obstruction of a firing train. By doing so, improvements in performance, reliability, and producibility may be provided.

There is a need to improve the overall safety and reliability of safety and arming devices in comparison to existing devices by combining electro-mechanical systems including at least two environments sensed by new and different mechanical systems.

BRIEF SUMMARY

Embodiments of the present invention comprise apparatuses and methods to improve the overall safety of safety and arming devices in comparison to existing devices by combining electro-mechanical systems including at least two environments sensed by different mechanical systems.

An embodiment of the invention comprises a safety and arming apparatus for use with a projectile. The safety and arming apparatus includes a rotor coupled to a housing with the rotor pivotable about an axis between a safe position and an armed position. The rotor includes a spin-lock engagement structure on a side surface of the rotor and a setback engagement structure. A first biasing element is coupled to the housing for holding a mass engaged with the setback engagement structure to restrain the rotor from rotation. The first biasing element is deformable to allow the mass to displace and disengage from the setback engagement structure upon an axial acceleration of the projectile, which permits rotation of the rotor. A second biasing element includes a fixed end coupled to the housing and a displaceable end for engaging with the spin-lock engagement structure on the rotor to restrain the rotor from rotation. The second biasing element is deformable to disengage the displaceable end from the spin-lock engagement structure upon a centrifugal acceleration of the projectile, which permits rotation of the rotor. A piston actuator is coupled to the housing and can be activated against the rotor to rotate the rotor to the armed position upon receipt of an electrical signal if the mass is disengaged and the displaceable end of the second biasing element is disengaged.

Another embodiment of the invention comprises a projectile including at least one explosive charge, a detonation cord operably coupled to the at least one explosive charge, a power source, fuze electronics operably coupled to the power source, and a safety and arming apparatus operably coupled to the fuze electronics and the detonation cord. The safety and arming apparatus includes a housing and a rotor coupled to the housing and pivotable about an axis between a safe position and an armed position. The rotor includes a spin-lock engagement structure on a side surface of the rotor and a setback engagement structure. A first biasing element is coupled to the housing and holds a mass engaged with the setback engagement structure to restrain the rotor from rotation. The first biasing element is deformable to allow the mass to displace and disengage from the setback engagement structure in response to a setback force on the projectile, which permits rotation of the rotor. A second biasing element includes a fixed end coupled to the housing and a displaceable end for engaging with the spin-lock engagement structure on the rotor to restrain the rotor from rotation. The second biasing element is deformable to disengage the displaceable end from the spin-lock engagement structure in response to a spin of the projectile, which permits rotation of the rotor. A piston actuator is coupled to the housing and can be activated against the rotor to rotate the rotor to the armed position upon receipt of an electrical signal from the fuze electronics if the mass is disengaged and the displaceable end of the second biasing element is disengaged. A detonator is disposed on the rotor and configured to be aligned with the detonation cord through an opening in a side of the housing when the rotor is in the armed position and unaligned with the detonation cord when the rotor is in the safe position.

Another embodiment of the invention comprises a method for safing a projectile. The method includes inhibiting rotation of a rotor pivotally coupled to a housing from a safe position to an armed position by biasing a mass against a setback engagement structure of the rotor. The rotor is further inhibited from rotating from the safe position to the armed position by biasing a displaceable end of a leaf spring against a spin-lock engagement structure on a side surface of the rotor. Either of the two methods of inhibiting rotation prevent initiation of a detonation cord operably coupled to the housing by maintaining the rotor in the safe position such that a detonator disposed in the rotor is not aligned with the detonation cord.

Yet another embodiment of the invention comprises a method for arming a projectile. The method includes displacing a mass away from a setback engagement structure of a rotor pivotally coupled to a housing in response to an axial acceleration of the projectile above an axial acceleration threshold. The displaced mass enables rotation of the rotor from a safe position to an armed position. The method also includes displacing a displaceable end of a leaf spring away from a spin-lock engagement structure on a side surface of the rotor in response to a spin of the projectile above a spin threshold. The displaced displaceable end further enables rotation of the rotor from the safe position to the armed position. The rotor is rotated from the safe position to the armed position by activating a piston actuator to align a detonator disposed in the rotor with a detonation cord operably coupled to the housing.

DETAILED DESCRIPTION

Figure 1A:
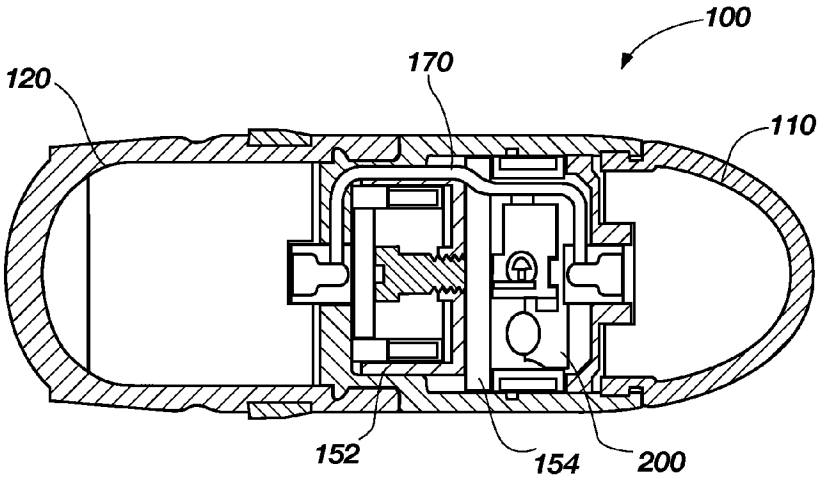
FIG. 1A is a simplified diagram of a projectile.

In the following detailed description, reference is made to the accompanying drawings that form a part hereof, and is shown by way of illustration specific embodiments in which the invention may be practiced. These embodiments are described in sufficient detail to enable those of ordinary skill in the art to practice the invention. It should be understood, however, that the detailed description and the specific examples, while indicating examples of embodiments of the invention, are given by way of illustration only and not by way of limitation. From this disclosure, various substitutions, modifications, additions rearrangements, or combinations thereof within the scope of the present invention may be made and will become apparent to those skilled in the art.

In accordance with common practice the various features illustrated in the drawings may not be drawn to scale. The illustrations presented herein are not meant to be actual views of any particular method, device, or system, but are merely idealized representations that are employed to describe various embodiments of the present invention. Accordingly, the dimensions of the various features may be arbitrarily expanded or reduced for clarity. In addition, some of the drawings may be simplified for clarity. Thus, the drawings may not depict all of the components of a given apparatus (e.g., device) or method. In addition, like reference numerals may be used to denote like features throughout the specification and figures.

It should be understood that any reference to an element herein using a designation such as "first," "second," and so forth does not limit the quantity or order of those elements, unless such limitation is explicitly stated. Rather, these designations may be used herein as a convenient method of distinguishing between two or more elements or instances of an element. Thus, a reference to first and second elements does not mean that only two elements may be employed there or that the first element must precede the second element in some manner. Also, unless stated otherwise a set of elements may comprise one or more elements.

Embodiments of the present invention comprise apparatuses and methods to improve the overall safety and reliability of the safety and arming apparatus in comparison to existing devices by combining electro-mechanical systems including at least two environments sensed by different mechanical systems in a safety and arming apparatus. These embodiments include a wide variety of applications and may be particularly useful for cannon projectile "smart" fuzes.

In describing the present invention, an example system and elements surrounding embodiments of the invention are first described to better understand the function of embodiments of the invention as they may be implemented with these systems and elements.

Figure 1B:
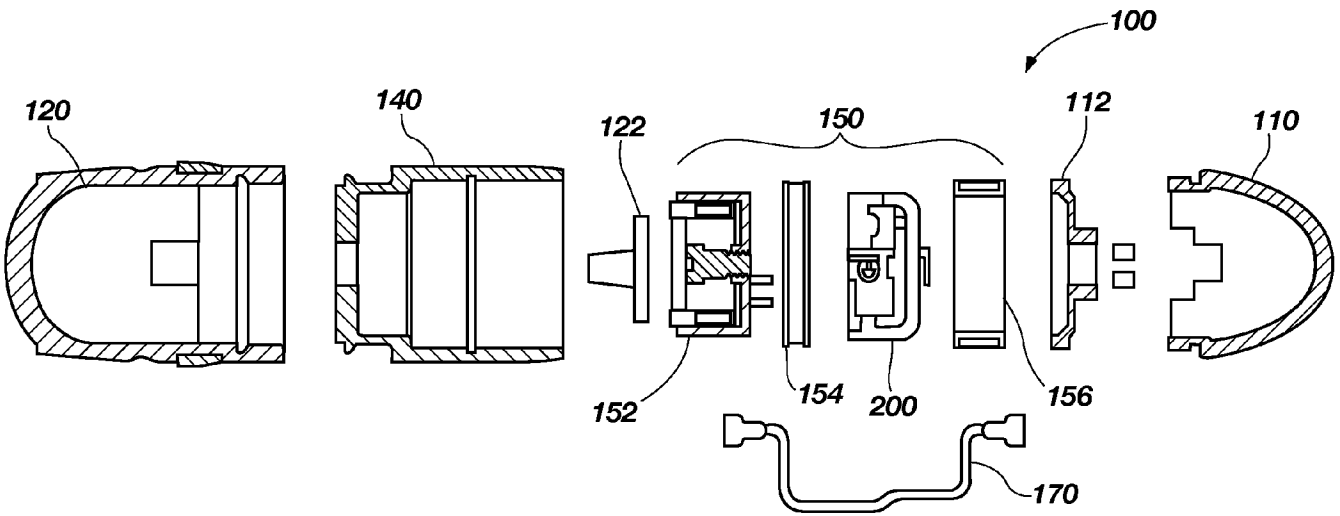
FIG. 1B is a simplified exploded view showing various components of the projectile of FIG. 1A.

FIG. 1A is a simplified diagram of a projectile 100 and FIG. 1B is a simplified exploded view showing various components of the projectile 100. The projectile 100 may include a forward projectile warhead 110 and an aft projectile warhead 120. These warheads 110 and 120 may also be referred to herein as explosive charges. A detonation cord 170 may couple to the forward projectile warhead 110, the aft projectile warhead 120 and a safety and arming apparatus 200.

Within a fuze 150, a power source 152 transfers its energy to fuze electronics 154 to charge a bank of capacitors (not shown). In some embodiments, the power source 152 may have a charge prior to launch. In other embodiments, the power source 152 may be activated by the launch of the projectile 100 in response to axial acceleration of the projectile 100.

A message coil 156 may be included so an external controller (not shown) can wirelessly impart a message to the fuze electronics 154 through the message coil 156. As a non-limiting example, prior to gun launch the fuze electronics 154 may be programmed, via the message, coil 156, to initiate detonation of the projectile 100 at a certain distance. At appropriate distances, under control of the fuze electronics 154 and as explained more fully below, the capacitors in the fuze electronics 154 discharge energy into the safety and arming apparatus 200 to a piston actuator (not shown in FIG.

1) and a detonator (not shown in FIG. 1). When the detonator initiates, it initiates the detonation cord 170, which transfers charge to the forward projectile warhead 110 and the aft projectile warhead 120.

An aft cord retainer 122 may hold the detonation cord 170 in place relative to the aft projectile warhead 120 and a forward cord retainer 112 may hold the detonation cord 170 in place relative to the forward projectile warhead 110.

A fuze container 140 may be used to hold the detonation cord 170, the aft cord retainer 122, the forward cord retainer 112, the power source 152, the fuze electronics 154, and the safety and arming apparatus 200 in place and in operable cooperation with each other.

This projectile 100 illustrated in FIG. 1 is used as an example only to illustrate a system in which embodiments of the present invention may be used. Many other explosive projectiles may use embodiments of the present invention, which may include many or all of the same elements as the example illustrated herein.

Figure 2:
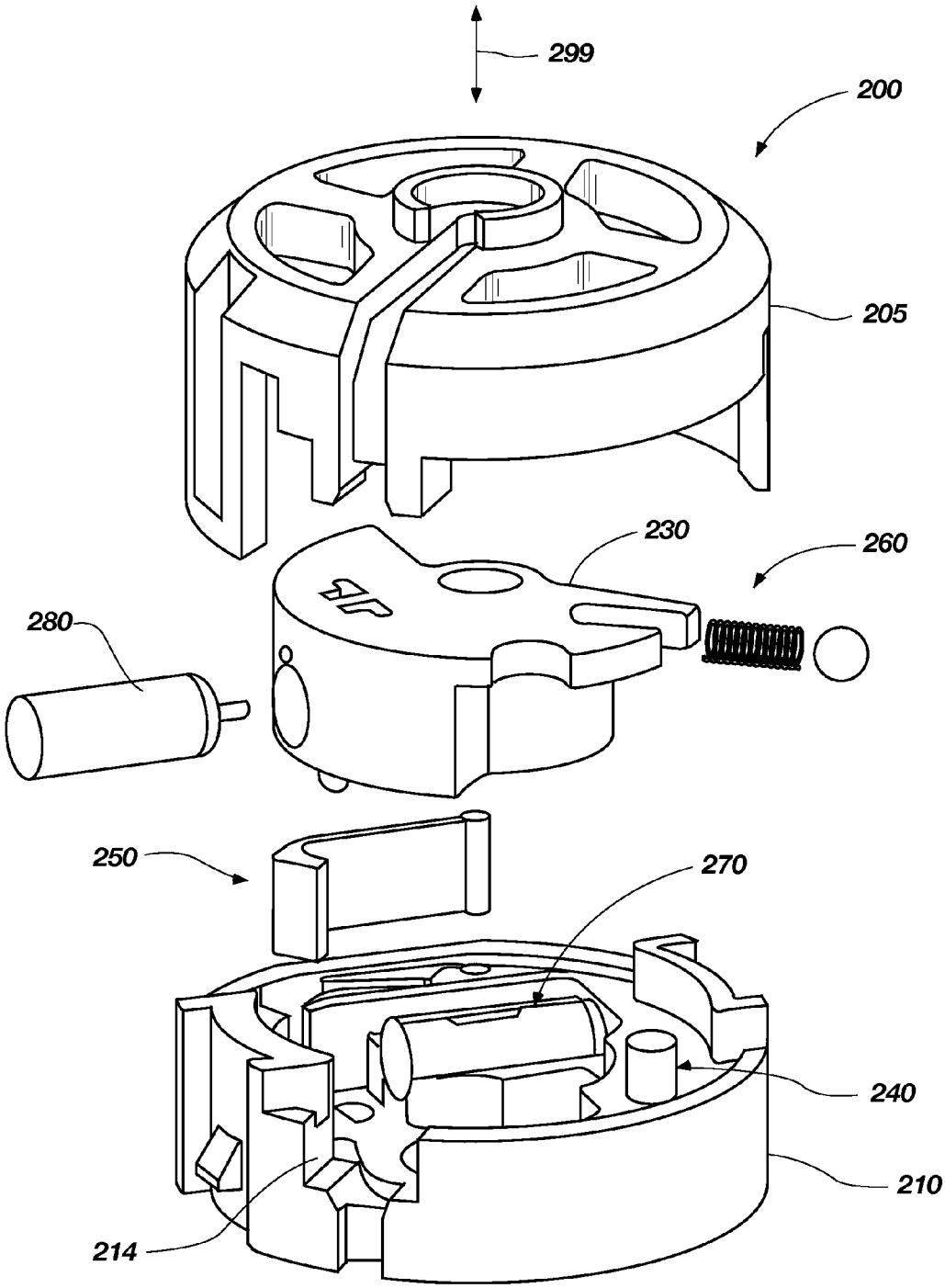
FIG. 2 is a simplified exploded view showing some components of a safety and arming apparatus.

FIG. 2 is a simplified exploded view showing some components of a safety and arming apparatus 200 according to one or more embodiments of the invention. As illustrated in FIG. 2, the safety and arming apparatus 200 includes a housing 210 and a cover 205 to form an encasement for the safety and arming apparatus 200. Functional elements within the encasement include a rotor 230, a detonator 280 disposed in an opening in a side of the rotor 230, and a piston actuator 270 disposed in the housing 210.

The housing 210, rotor 230, and cover 205 all may be plastic parts, optimized for enhanced performance and reliability over the operating and storage temperature range of the fuze. Of course, many other materials may be suitable for use in various embodiments of the invention.

The rotor is configured to rotate (i.e., pivot) within the housing 210 about an axis 299 between a safe position and an armed position. In other words, the safety and arming apparatus 200 uses an out-of-line rotor configuration in which the detonator 280 is mounted in the rotor 230 in the safe position such that the detonator 280 is out of line with the detonation cord 170 (FIG. 1). The safety and arming apparatus 200 is safe when the rotor 230 is in the out-of-line position (i.e., the safe position) because the detonation cord 170 is shielded from the detonator 280. When the rotor is pivoted to an in-line position (i.e., the armed position) the detonator 280 is proximate the detonation cord 170 through an opening 214 in the housing 210 to enable propagation of charge from the detonator 280 through the detonation cord 170 to ignite the explosive charges 110 and 120 (FIG. 1).

The rotor 230 is held out-of-line by two independent restraints. A first rotation restraint 240 is disposed in the housing 210 and engages the rotor 230 to restrain it until a first environmental criterion is met. A second rotation restraint 250 is also disposed in the housing 210 and engages the rotor 230 to restrain it until a second environmental criterion is met. A setback retainer 260 is disposed in a slot of the rotor 230 to engage with the first rotation restraint 240 as explained below.

The detonator 280 may include an explosive charge, which is initiated when a certain electrical signal is passed to the fuze electronics 154 (FIG. 1) to the detonator 280. As non-limiting examples, the electrical signal may be passed with electrical contacts, wires, or other suitable arrangement. This electrical signal is passed when the appropriate projectile range is reached. When the detonator 280 is initiated, it passes its energy into initiating the rest of the fuze firing train, which eventually results in the detonation of the projectile warheads 110 and 112 (FIG. 1).

Figure 3:
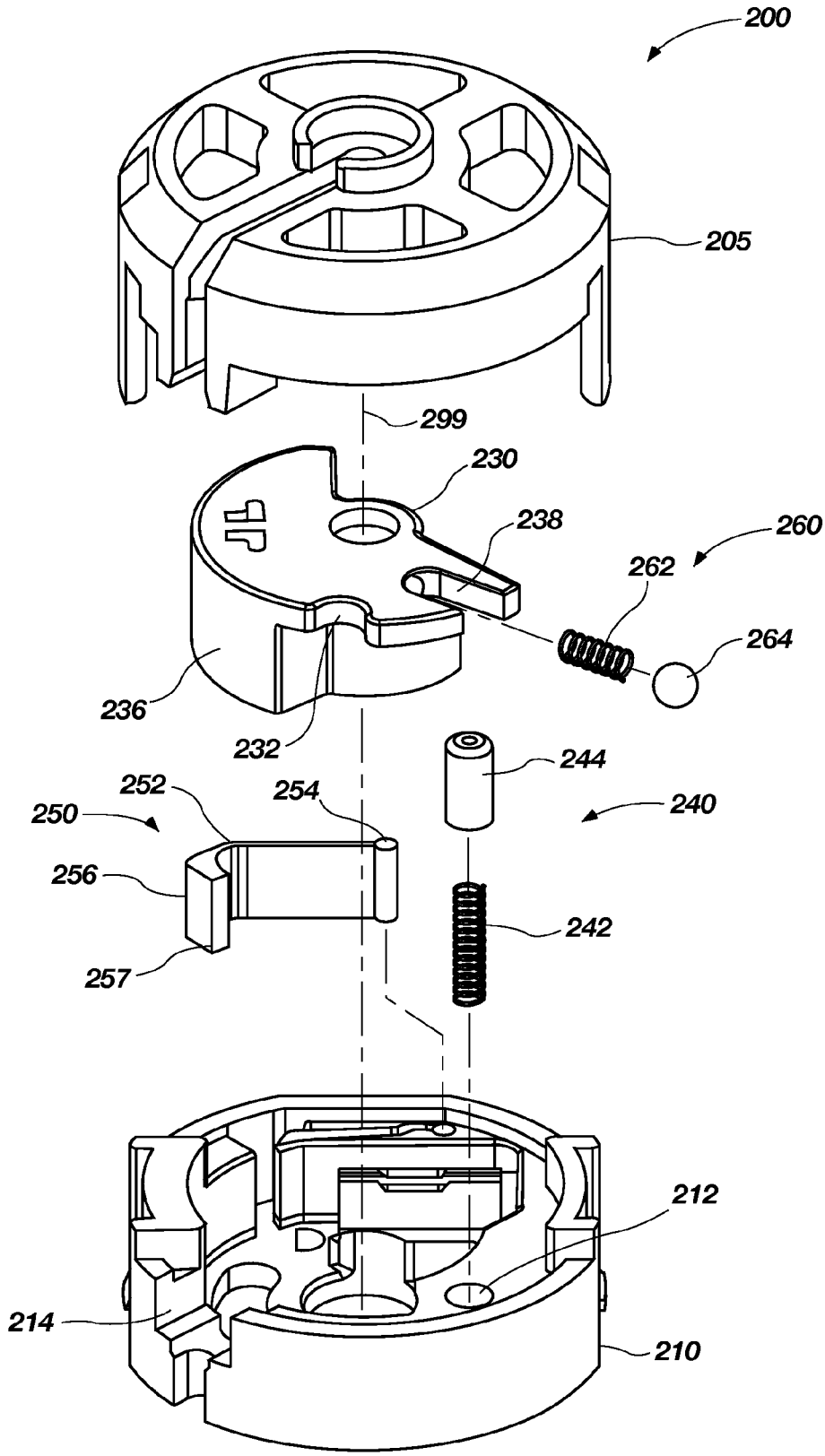
FIG. 3 is a simplified exploded view showing additional components of the safety and arming apparatus of FIG. 2.

FIG. 3 is a simplified exploded view showing additional components and additional detail of the safety and arming apparatus 200 of FIG. 2. The housing 210 and cover 205 are shown in FIG. 3, however for simplicity and to not clutter the drawing in unnecessary detail, the detonator 280 and piston actuator 270 are not shown.

As explained earlier, part of the S&A function is to prevent premature detonation. Embodiments of the present invention incorporate two independent environmental criteria to determine that the projectile 100 may be safely armed. Furthermore, each environmental criterion is detected by a mechanical function that inhibits the rotor 230 from pivoting from the safe position to the armed position until the environmental criterion is met.

The first environmental criterion used to enable arming is an axial acceleration magnitude, which may also be referred to herein as a setback force. This first environmental criterion is sensed by the first rotation restraint 240. The second environmental criterion is related to spin of the projectile 100 about a longitudinal axis 299. This second environmental criterion is sensed by the second rotation restraint 250. The spin may be sensed as a centrifugal acceleration, which is correlated to a spin rate of the projectile.

The first rotation restraint 240 includes a first biasing element 242 (which may be configured as a helical spring 242) disposed in a cavity 212 of the housing 210. A mass 244 (also referred to herein as a setback pin 244) is biased by the first helical spring 242 to be held in a slot 238 (also referred to herein as a channel 238 and a setback engagement structure 238) in the rotor 230. Thus, in the safe position, the setback pin 244 is partially disposed in the cavity 212 of the housing and partially disposed in the channel 238 of the rotor 230 to prevent the rotor 230 from pivoting.

At projectile launch, the axial acceleration of the projectile causes the setback pin 244 to displace against the helical spring 242 and when an axial acceleration threshold is reached the setback pin 244 moves far enough into the cavity 212 to disengage from the channel 238 in the rotor 230. With the setback pin 244 disengaged, the first rotation restraint 240 no longer inhibits the rotor 230 from pivoting about the axis 299.

A setback retainer 260 includes a ball 264 and a third biasing element 262 disposed in the channel 238. Initially, the third element 262 is deformed and holds the ball 264 against a side of the setback pin 244. When the setback pin 244 moves down far enough to disengage from the channel 238, the third biasing element 262 extends and pushes the ball 264 over the top of the setback pin 244 to hold the setback pin 244 disengaged from the channel 238. This function will be discussed below and be easier to visualize with reference to FIGS. 4A-5B.

The second rotation restraint 250 includes a second biasing element 252 (also referred to herein as a leaf spring 252) with a fixed end 254 that is held in a fixed position within the housing 210 and a displaceable end 256 that includes a catch portion 257, which engages with spin-lock engagement structure 234 (FIG. 5A) in a side surface 236 of the rotor 230.

Initially, with the rotor 230 in the safe position, the catch portion 257 of the leaf spring 252 is engaged with a spin-lock engagement structure 234 (FIG. 5A) to prevent the rotor 230 from pivoting. After projectile launch, the projectile 100 begins to spin due to rifling in the gun barrel. As the spin rate increases, centrifugal acceleration increases, which displaces the displaceable end 256 and the catch portion 257 away from the rotor 230. With the catch portion 257 disengaged, the second rotation restraint 250 no longer inhibits the rotor 230 from pivoting. An indentation 232 in the side of the rotor 230 is discussed below with reference to FIGS. 4A and 4B. Additional detail of the leaf spring 252 between the safe position and the aimed position is discussed below with reference to FIGS. 5A and 5B.

While the biasing elements shown and described herein may be illustrated as helical springs and leaf springs, those of ordinary skill in the art will recognize that many other elastically deformable biasing devices and materials may be used in embodiments of the present invention.

Figure 4A:
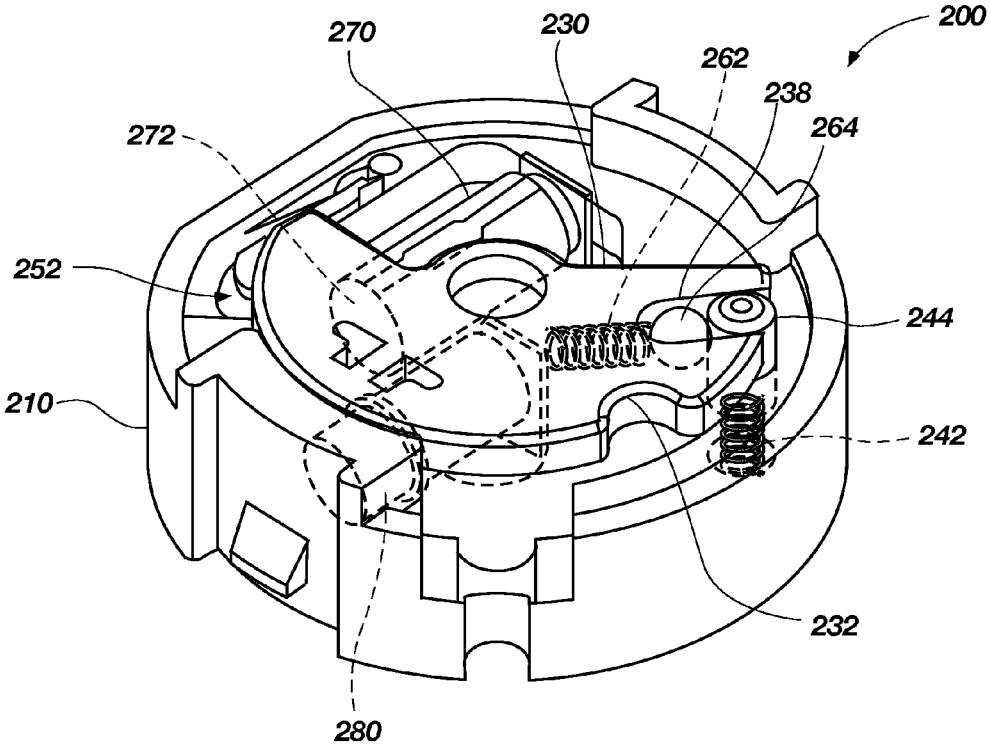
FIGS. 4A and 4B are simplified perspective views showing a safety and arming apparatus in a safe position and an armed position, respectively.
Figure 4B:
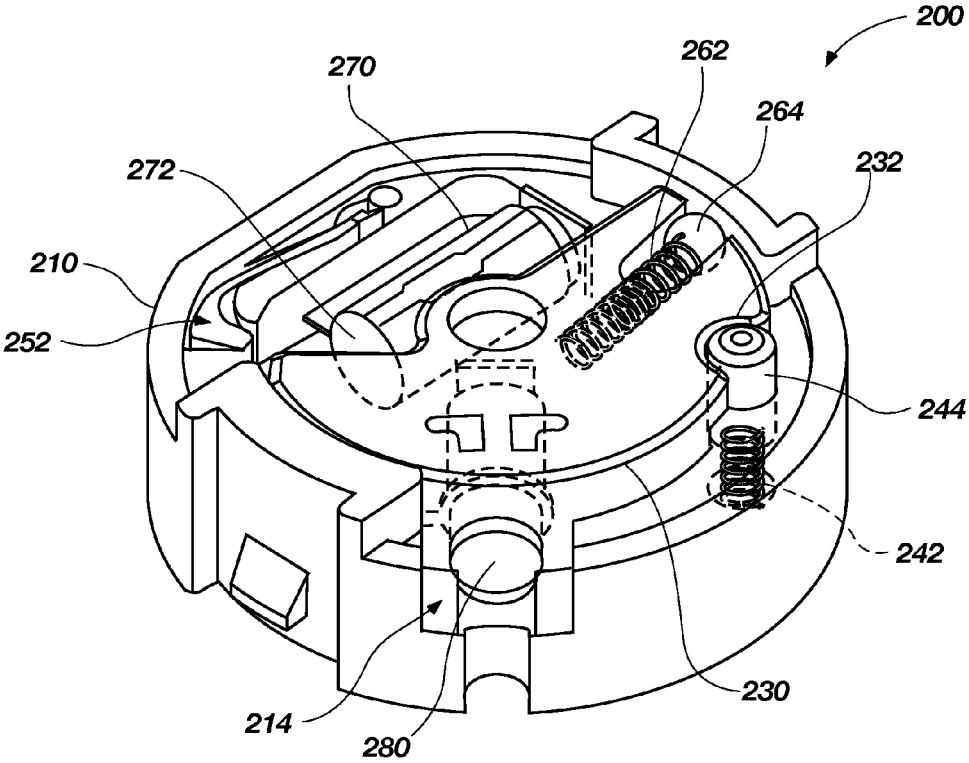

FIGS. 4A and 4B are simplified perspective views showing the safety and arming apparatus 200 in a safe position and an armed position, respectively. In the safe position shown in FIG. 4A, the setback pin 244 is in an extended position where it is engaged with the channel 238 in the rotor 230 and the cavity in the housing 210, thus preventing the rotor 230 from pivoting and maintaining the safety and arming apparatus 200 in the safe position. In the armed position shown in FIG. 4B, the setback pin 244 is also in an extended position but is now engaged with the indentation 232 in the rotor 230 and the cavity in the housing 210, thus preventing the rotor 230 from pivoting and maintaining the safety and arming apparatus 200 in the armed position. As explained earlier, to release the rotor 230 to move from the safe position to the armed position the setback pin 244 is disengaged from the channel 238 allowing the ball 264 to be pushed over the setback pin 244 and preventing the setback pin 244 from re-engaging with the channel 238. However, in the armed position of FIG. 4B the channel 238 holding the ball 264 has rotated away from the setback pin 244 and the setback pin 244 is free to engage with the indentation 232 by the first biasing element 242 pushing the setback pin 244 into the indentation 232.

In the safe position of FIG. 4A, the piston actuator 270 has not yet deployed a plunger 272. In FIG. 4B, the piston actuator 270 has deployed the plunger 272 to push the rotor 230 to the armed position, at which time the plunger 272 may return to its original position. The detonator 280 can be seen misaligned with the opening 214 in the housing 210 in the safe position of FIG. 4A and aligned with the opening 214 in the housing 210 in the armed position of FIG. 4B. The leaf spring 252 will be discussed in more detail with reference to FIGS. 5A and 5B.

Figure 5A:
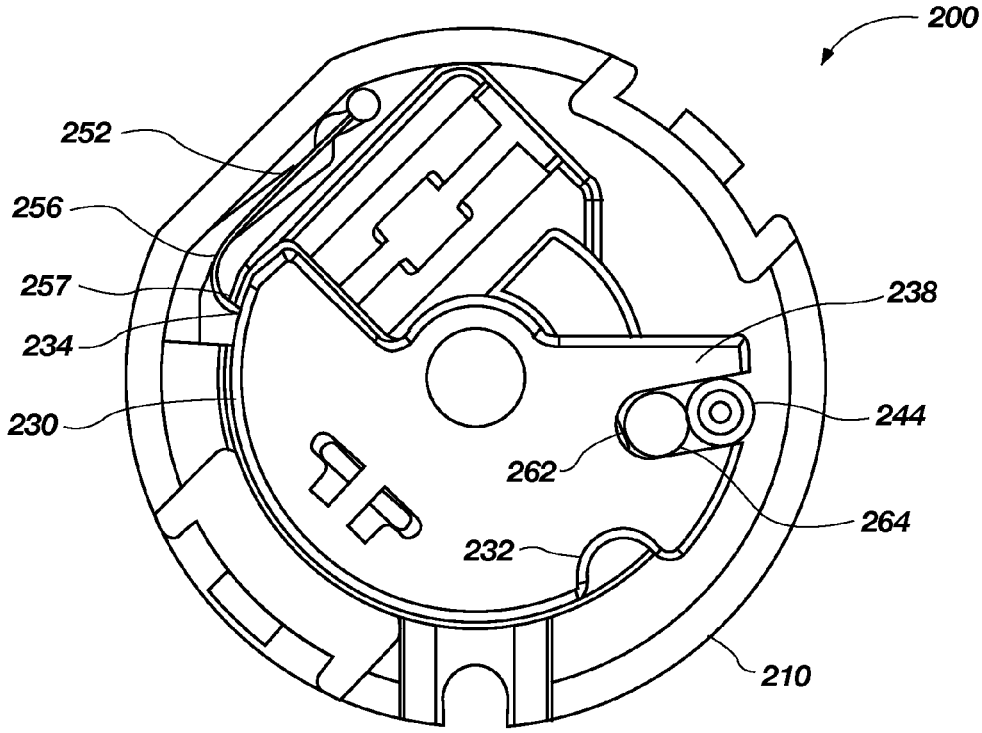
FIGS. 5A and 5B are simplified top views showing a safety and arming apparatus in a safe position and an armed position, respectively.
Figure 5B:
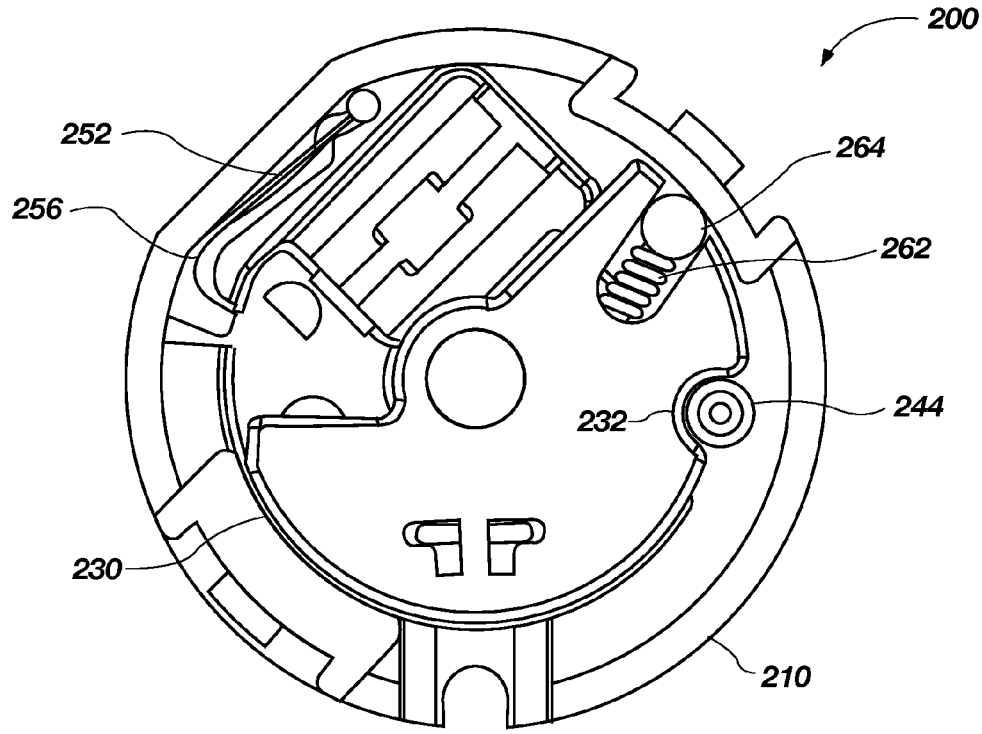

FIGS. 5A and 5B are simplified top views showing the safety and arming apparatus 200 in a safe position and an armed position, respectively. The spin lock 250 (i.e., the second rotation restraint 250), is defeated once the projectile has "spun-up" to a certain frequency. The spring head 257 (i.e., the catch portion 257) of the leaf spring 252 engages a spin-lock engagement structure 234 in the side of the rotor 230. The spin-lock engagement structure 234 may be any suitable structure for engaging with the spring head 257, such as, for example, a groove, a slot, a rim, or a ledge.

At a certain spin rate, the displaceable end 256 of the leaf spring 252 moves outward away from the rotor 230 until the spring head 257 is completely disengaged from the rotor 230. Throughout the flight of the projectile, the angular acceleration of the projectile is sufficient to keep the spring head 257 disengaged from the rotor 230 to allow the rotor 230 to pivot.

Also shown in FIGS. 5A and 5B, the ball 264 can be seen biased against the setback pin 244 with the third biasing element 262 in the safe position of FIG. 5A. In the armed position of FIG. 5B, the setback pin 244 can be seen engaged with the indentation 232 and the ball 264 has moved out of the way of the setback pin 244 with the rotation of the rotor 230. Both the setback pin 244 and the spin lock 250 must be defeated in order for the rotor 230 to move into the armed position. In addition, the rotor 230 contains a shear tab.

Figure 6:
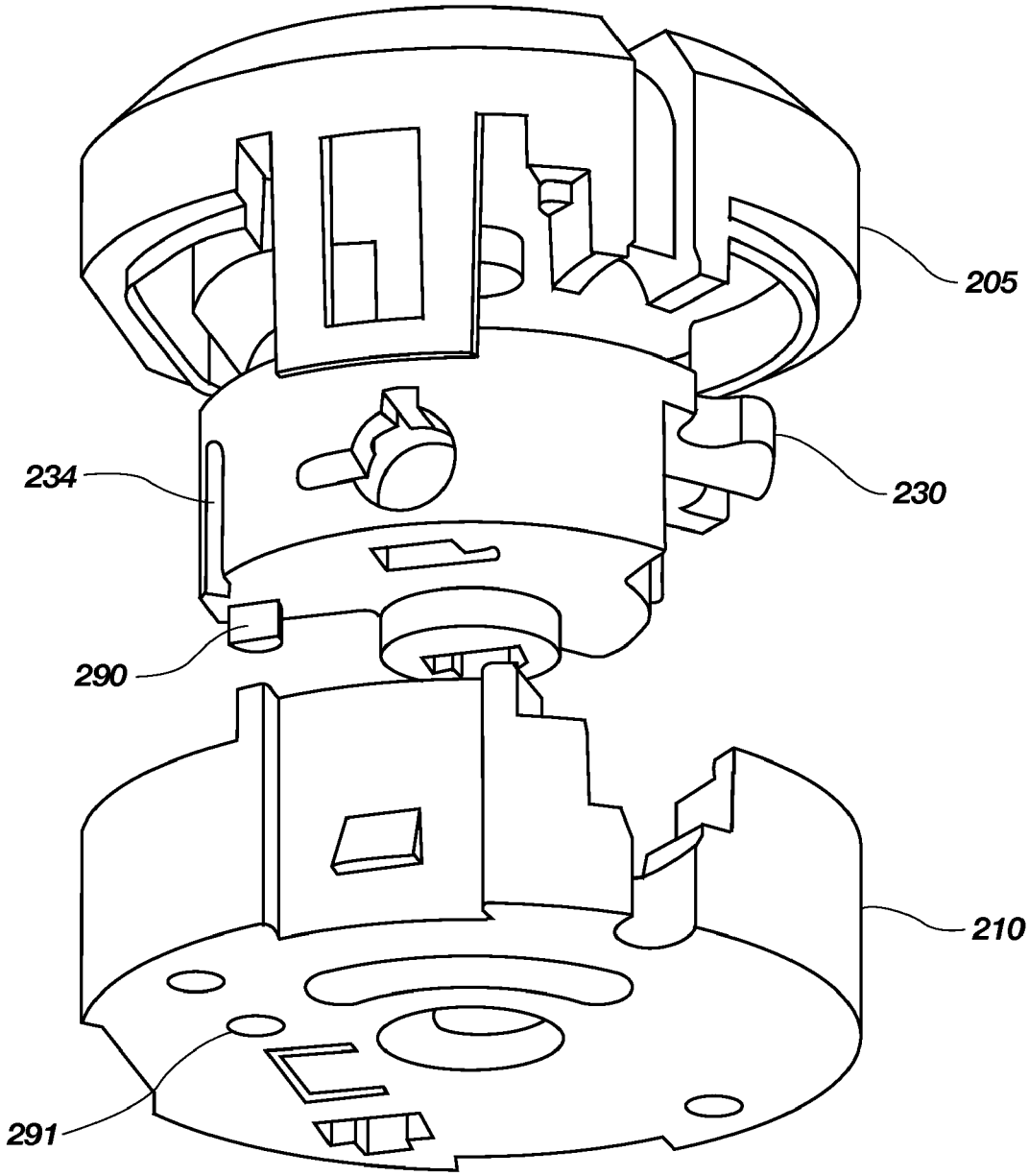
FIG. 6 is an explode view of a rotor and a housing showing a shear tab.

FIG. 6 is an exploded view of the cover 205, rotor 230 and the housing 210 showing the shear tab 290. The shear tab 290 can be seen extending from a bottom side of the rotor 230. In addition, the spin-lock engagement structure 234 is shown on a side of the rotor 230. The housing 210 includes a shear tab engagement structure 291, which the shear tab fits into when the rotor 230 is assembled with the housing 210. The shear tab 290 creates a safety detent to hold the rotor 230 in the safe position until the piston actuator 270 (see FIGS. 4A and 4B) is fired. In other words, when in the armed position with the setback pin 244 and spin lock 250 defeated, the shear tab 290 holds the rotor 230 in place until the piston actuator 270 is fired, which shears off the shear tab 290 and pivots the rotor 230 to the armed position.

Figure 7:
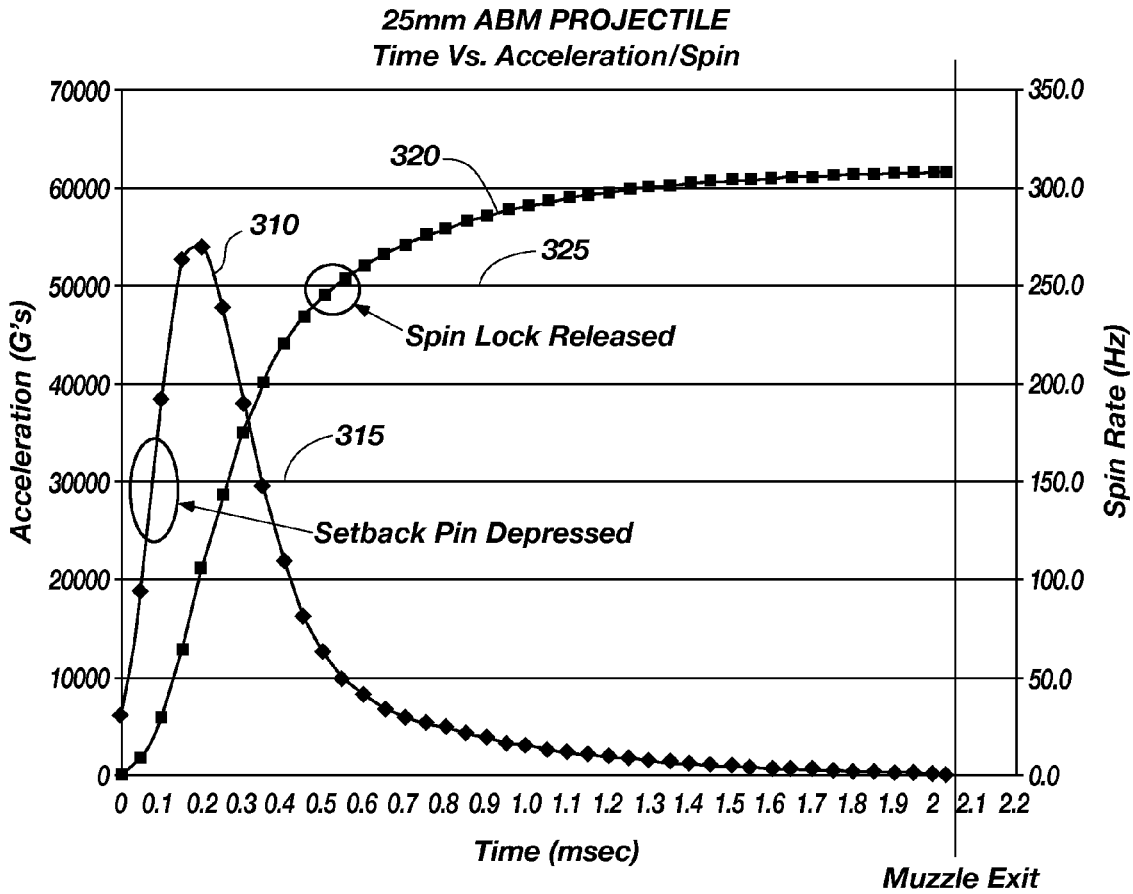
FIG. 7 is a graph showing two different environmental factors experienced by a projectile.

FIG. 7 is a graph showing two different environmental factors experienced by a projectile. An axial acceleration profile 310 illustrates the axial acceleration experience by the projectile as it is fired from the gun barrel. When an axial acceleration threshold 315 (also referred to herein as a setback force threshold 315) of about 30,000 Gs is exceeded, the setback pin is depressed. A spin profile 320 illustrates the spin rate experience by the projectile as it is fired from the gun barrel. When a spin threshold 325 (also referred to herein as a centrifugal acceleration threshold 325) of about 250 Hz is exceeded, the spin lock is released. FIG. 7 is an example for a 25 mm Air Burst Munition Projectile. Those of ordinary skill in the art will recognize that other thresholds may be suitable for this specific projectile and other thresholds may be suitable for other projectiles within the scope of the present invention.

Figure 8:
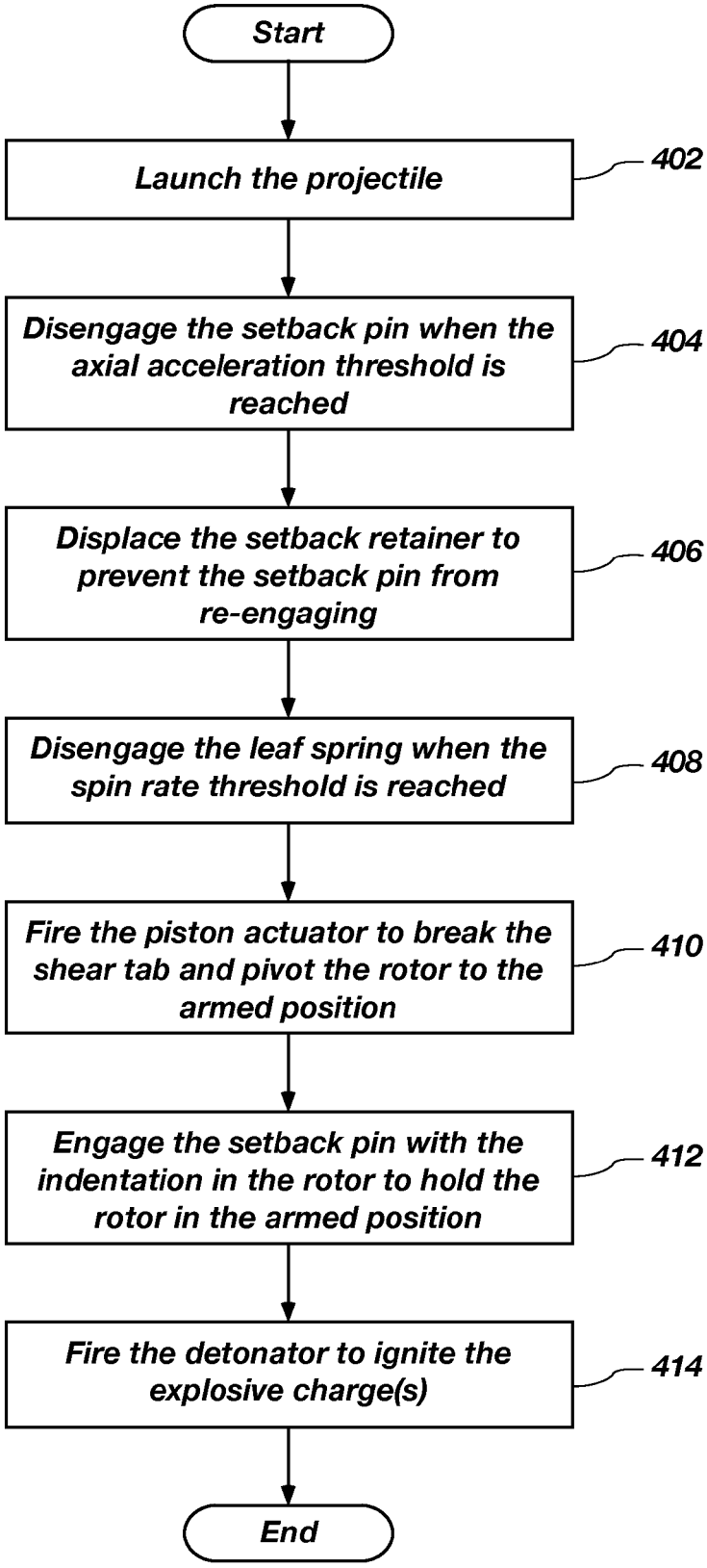
FIG. 8 is a simplified flow chart showing events that may occur between launch and detonation of a projectile.

FIG. 8 is a simplified flow chart showing events that may occur between launch and detonation of a projectile. In describing the operation of FIG. 8, reference is also made to the other figures with respect to operation of specific elements. In operation block 402, the projectile 100 is launched. In operation block 404, the setback pin 244 is disengaged due to the first environmental criterion being met. As a non-limiting example, and as shown in FIG. 7, disengagement of the setback pin 244 may occur at about 0.1 milliseconds after the gun is fired. In operation block 406, the setback retainer 260 displaces the ball 264 over the setback pin 244 to prevent the setback pin 244 from re-engaging with the channel 238, which will occur when the setback pin 244 has cleared the channel 238 enough for the ball 264 to be displaced over the setback pin 244.

In operation block 408, the leaf spring 252 is disengaged from the rotor 230 when the spin rate threshold 235 has been met. As a non-limiting example, and as shown in FIG. 7, disengagement of the leaf spring 252 may occur at about 0.55 milliseconds after the gun is fired. In operation block 410, the piston actuator 270 is fired to break the shear tab 290 and pivot the rotor 230 to the armed position.

With the rotor 230 in the armed position, in operation block 412, the setback pin 244 is engaged with the indentation 232 in the rotor 230 to hold the rotor 230 in the armed position. With the safety and arming apparatus 200 armed, in operation block 414, the detonator 280 is initiated and its energy is transferred through the detonation cord 170 to ignite the explosive charges in forward and aft projectile warheads 110 and 120.

In the embodiment discussed in FIG. 7, the projectile 100 exits the gun barrel at about 2 milliseconds after firing. As a non-limiting example, the piston actuator 270 may be aimed at about 250 milliseconds after the projectile 100 has left the gun barrel (i.e., muzzle exit) and has traveled a safe distance away from the gun. As another example, turns turn counts from the fuze electronics 154 may also be used to determine a safe distance.

The detonator 280 may be ignited at a programmed time after launch or from the sensing of other environmental factors such as, for example, impact with an object, grazing an object, or proximity to an object.

Although the present invention has been described with reference to particular embodiments, the present invention is not limited to these described embodiments. Rather, the present invention is limited only by the appended claims and their legal equivalents.

What is claimed is:

1. A safety and arming apparatus for use with a projectile, comprising:

a housing;

a rotor coupled to the housing and pivotable about an axis between a safe position and an armed position, the rotor including a spin-lock engagement structure on a side surface of the rotor and a setback engagement structure;

a first biasing element coupled to the housing and for holding a mass engaged with the setback engagement structure to restrain the rotor from rotation, the first biasing element deformable to allow the mass to displace and disengage from the setback engagement structure upon an axial acceleration of the projectile and permit rotation of the rotor;

a second biasing element including a fixed end coupled to the housing and a displaceable end for engaging with the spin-lock engagement structure on the rotor to restrain the rotor from rotation, the second biasing element deformable to disengage the displaceable end from the spin-lock engagement structure upon a centrifugal acceleration of the projectile and permit rotation of the rotor; and a piston actuator coupled to the housing for activation against the rotor to rotate the rotor to the armed position upon receipt of an electrical signal if the mass is disengaged and the displaceable end of the second biasing element is disengaged.

2. The apparatus of claim 1, further comprising a setback retainer, comprising:

a ball disposed in the channel of the rotor; and a helical spring disposed in the channel, and configured to:

bias the ball against a side of the setback pin when the setback pin is engaged with the channel; and bias the ball over the setback pin when the setback pin is displaced away from the setback engagement structure to retain the setback pin in a displaced position that is disengaged from the setback engagement structure.

3. The apparatus of claim 1, wherein:

the spin-lock engagement structure comprises a slot on the side surface of the rotor; and the second biasing element comprises a leaf spring including a catch portion for engaging with the slot when the centrifugal acceleration of the projectile is less than a centrifugal acceleration threshold and disengaging from the slot when the centrifugal acceleration of the projectile is equal to or greater than the centrifugal acceleration threshold.

4. The apparatus of claim 1, wherein:

the setback engagement structure comprises a channel formed in the rotor;

the first biasing element comprises a helical spring disposed in a cavity of the housing; and the mass comprises a setback pin biased against the helical spring and at least partially disposed in the cavity and biased to engage with the channel when the axial acceleration of the projectile is less than an axial acceleration threshold and disengage from the channel when the axial acceleration of the projectile is equal to or greater than the axial acceleration threshold.

5. The apparatus of claim 4, further comprising a setback retainer, comprising:

a third biasing element disposed in a channel of the rotor; and a ball disposed in the channel, wherein the ball is to be:

biased between the third biasing element and the mass when the mass is engaged with the setback engagement structure; and biased over the mass with the third biasing element when the mass is displaced away from the setback engagement structure and the rotor is in the safe position to retain the mass in a displaced position and disengaged from the setback engagement structure.

6. The apparatus of claim 1, further comprising:

an opening in a side of the housing; and a detonator disposed on the rotor and configured to be unaligned with the opening when the rotor is in the safe position and aligned with opening when the rotor is in the armed position.

7. The apparatus of claim 1, further comprising a shear tab connected to the rotor for preventing the rotor from moving from the safety position to the armed position until the piston actuator is activated.

8. A safety and arming apparatus for use with a projectile, comprising:

a housing;

a rotor coupled to the housing and pivotable about an axis between a safe position and an armed position, the rotor including a spin-lock engagement structure on a side surface of the rotor and a setback engagement structure;

a first biasing element coupled to the housing and for holding a mass engaged with the setback engagement structure to restrain the rotor from rotation, the first biasing element deformable to allow the mass to displace and disengage from the setback engagement structure upon an axial acceleration of the projectile and permit rotation of the rotor;

a second biasing element including a fixed end coupled to the housing and a displaceable end for engaging with the spin-lock engagement structure on the rotor to restrain the rotor from rotation, the second biasing element deformable to disengage the displaceable end from the spin-lock engagement structure upon a centrifugal acceleration of the projectile and permit rotation of the rotor; and a piston actuator coupled to the housing for activation against the rotor to rotate the rotor to the armed position upon receipt of an electrical signal if the mass is disengaged and the displaceable end of the second biasing element is disengaged;

wherein the first biasing element is configured to displace the mass to engage with an indentation in the side surface of the rotor when the rotor is rotated to the armed position.

9. A projectile, comprising:

at least one explosive charge;

a detonation cord operably coupled to the at least one explosive charge;

a power source;

fuze electronics operably coupled to the power source; and a safety and arming apparatus operably coupled to the fuze electronics and the detonation cord, the safety and arming apparatus, comprising:

a housing;

a rotor coupled to the housing and pivotable about an axis between a safe position and an armed position, the rotor including a spin-lock engagement structure on a side surface of the rotor and a setback engagement structure;

a first biasing element coupled to the housing and holding a mass engaged with the setback engagement structure to restrain the rotor from rotation, the first biasing element deformable to allow the mass to displace and disengage from the setback engagement structure responsive to a setback force on the projectile and permit rotation of the rotor;

a second biasing element including a fixed end coupled to the housing and a displaceable end for engaging with the spin-lock engagement structure on the rotor to restrain the rotor from rotation, the second biasing element deformable to disengage the displaceable end from the spin-lock engagement structure responsive to a spin of the projectile and permit rotation of the rotor;

a piston actuator coupled to the housing for activation against the rotor to rotate the rotor to the armed position upon receipt of an electrical signal from the fuze electronics if the mass is disengaged and the displaceable end of the second biasing element is disengaged; and a detonator disposed on the rotor and configured to be aligned with the detonation cord through an opening in a side of the housing the when the rotor is in the armed position and unaligned with the detonation cord when the rotor is in the safe position.

10. The projectile of claim 9, further comprising a setback retainer, comprising:

a third biasing element disposed in a channel of the rotor; and a ball disposed in the channel, wherein the ball is:

biased between the third biasing element and the mass when the mass is engaged with the setback engagement structure; and biased over the mass when the mass is displaced away from the setback engagement structure to retain the mass in a displaced position that is disengaged from the setback engagement structure.

11. The projectile of claim 9, wherein:

the spin-lock engagement structure comprises a slot on the side surface of the rotor; and the second biasing element comprises a leaf spring including a catch portion for engaging with the slot when a spin rate of the projectile is less than a spin threshold and disengaging from the slot when the spin rate of the projectile is equal to or greater than the spin threshold.

12. The projectile of claim 9, wherein:

the setback engagement structure comprises a channel formed in the rotor;

the first biasing element comprises a helical spring disposed in a cavity of the housing; and the mass comprises a setback pin biased against the helical spring and at least partially disposed in the cavity and biased to engage with the channel when the setback force of the projectile is less than an setback force threshold and disengage from the channel when the setback force of the projectile is equal to or greater than the setback force threshold.

13. The projectile of claim 9, further comprising a shear tab connected to the rotor for preventing the rotor from moving from the safety position to the armed position until the piston actuator is activated.

14. The projectile of claim 9, wherein the at least one explosive charge comprises a forward projectile warhead and an aft projectile warhead.

15. A projectile, comprising:

at least one explosive charge;

a detonation cord operably coupled to the at least one explosive charge;

a power source;

fuze electronics operably coupled to the power source; and a safety and arming apparatus operably coupled to the fuze electronics and the detonation cord, the safety and arming apparatus, comprising:

a housing;

a rotor coupled to the housing and pivotable about an axis between a safe position and an armed position, the rotor including a spin-lock engagement structure on a side surface of the rotor and a setback engagement structure;

a first biasing element coupled to the housing and holding a mass engaged with the setback engagement structure to restrain the rotor from rotation, the first biasing element deformable to allow the mass to displace and disengage from the setback engagement structure responsive to a setback force on the projectile and permit rotation of the rotor;

a second biasing element including a fixed end coupled to the housing and a displaceable end for engaging with the spin-lock engagement structure on the rotor to restrain the rotor from rotation, the second biasing element deformable to disengage the displaceable end from the spin-lock engagement structure responsive to a spin of the projectile and permit rotation of the rotor;

a piston actuator coupled to the housing for activation against the rotor to rotate the rotor to the armed position upon receipt of an electrical signal from the fuze electronics if the mass is disengaged and the displaceable end of the second biasing element is disengaged; and a detonator disposed on the rotor and configured to be aligned with the detonation cord through an opening in a side of the housing the when the rotor is in the armed position and unaligned with the detonation cord when the rotor is in the safe position;

wherein the first biasing element is configured to displace the mass to engage with an indentation in the side surface of the rotor when the rotor is rotated to the armed position.

* * * * *

UNITED STATES PATENT AND TRADEMARK OFFICE

CERTIFICATE OF CORRECTION

PATENT NO. : 8,291,825 B2
APPLICATION NO. : 12/557028
DATED : October 23, 2012
INVENTOR(S) : Hossein Aliaghai, Kristen L. Gerzina and Dennis Lagerquist It is certified that error appears in the above-identified patent and that said Letters Patent is hereby corrected as shown below:

In the specification:

| | | |
|---|---|---|
| COLUMN 4, | LINE 62, | change “the message,” to --the message-- |
| COLUMN 9, | LINE 1, | change “turns turn” to --turn-- |

In the claims:

| | | | |
|---|---|---|---|
| CLAIM 9, | COLUMN 11, | LINE 33, | change “housing the when” to --housing when-- |
| CLAIM 13, | COLUMN 12, | LINE 4, | change “an setback” to --a setback-- |
| CLAIM 15, | COLUMN 12, | LINE 53, | change “housing the when” to --housing when-- |

Signed and Sealed this
First Day of April, 2014

Michelle K. Lee

Michelle K. Lee
*Deputy Director of the United States Patent and Trademark Office*